United States Patent [19]

Wakimoto et al.

[11] Patent Number: 5,023,603

[45] Date of Patent: Jun. 11, 1991

[54] DISPLAY CONTROL DEVICE

[75] Inventors: Kingo Wakimoto, Itami; Kousaku Takeda, Kamakura, both of Japan

[73] Assignee: Mitsubishi Denki Kabushiki Kaisha, Tokyo, Japan

[21] Appl. No.: 359,324

[22] Filed: May 31, 1989

[30] Foreign Application Priority Data

Feb. 21, 1989 [JP] Japan ..... 1-42475

[51] Int. Cl.[5] ..... G09G 3/00

[52] U.S. Cl. ..... 340/793; 340/703; 358/30

[58] Field of Search ..... 340/701, 703, 767, 793; 358/30

[56] References Cited

U.S. PATENT DOCUMENTS

| | | | |
|---|---|---|---|
| 4,236,175 | 11/1980 | Groothuis | 358/30 |
| 4,481,529 | 11/1984 | Kerling | 358/30 |
| 4,549,172 | 10/1985 | Welk | 340/703 |
| 4,626,835 | 12/1986 | Nienaber et al. | 340/703 |
| 4,688,031 | 8/1987 | Haggerty | 340/793 |
| 4,725,833 | 2/1988 | Nakamura | 340/793 |
| 4,727,414 | 2/1988 | Ranf et al. | 358/30 |
| 4,779,083 | 10/1988 | Ishii et al. | 340/793 |
| 4,977,398 | 12/1990 | Pleva et al. | 358/30 |

FOREIGN PATENT DOCUMENTS

| | | |
|---|---|---|
| 0193728 | 9/1986 | European Pat. Off. . |
| 0254805 | 2/1988 | European Pat. Off. . |
| 0347720 | 12/1989 | European Pat. Off. . |

*Primary Examiner*—Jeffery A. Brier
*Assistant Examiner*—M. Fatahiyar
*Attorney, Agent, or Firm*—Oblon, Spivak, McClelland, Maier & Neustadt

[57] ABSTRACT

A gradation level selecting circuit for selecting a gradation level consists of first and second selecting circuits (28, 29) and a selector (30). The first selecting circuit selects one of gradation level signals from a gradation level generator in accordance with monochrome data from a monochrome data generator (24) and predetermined one of color data from a color data generator (23). The second selecting circuit selects one of the gradation level signals in accordance with the color data. The selector (30) selects an output of the first selecting circuit (28) or an output of the second selecting circuit (29) in response to a content of a switching resistor (25), to supply it to a monochrome display device. Thus, appropriate gradation display can be carried out by the monochrome display device using software either for color display or for monochrome display.

8 Claims, 5 Drawing Sheets

DISPLAY CONTROL DEVICE

BACKGROUND OF THE INVENTION

1. Field of the Invention

The present invention relates to a display control device for displaying in gradation a picture which is an output from a computer system, for example, on a monochrome display device such as a monochrome liquid crystal display.

2. Description of the Background Art

FIG. 1 is a schematic block diagram showing this kind of conventional display control device. As shown in FIG. 1, a synchronizing signal generator 1 receives a clock signal CLK to generate horizontal and vertical synchronizing signals. A gradation level generator 2 receives the vertical synchronizing signal 3 of these synchronizing signals to generate a group of gradation level signals 4 shown in FIG. 2. In the case of a display control device for liquid crystal display, for example, the clock signal CLK is referred to as a dot clock signal, and the vertical synchronizing signal 3 as a frame signal, respectively.

Usually, a frame thinning system is employed on carrying out gradation display on a monochrome liquid crystal display. The "frame" herein means a cycle during which one picture is displayed on a display, that is, a duration beginning with displaying the first line of a certain picture on the display through the display of the last line to just before the display of the first line of the next picture. In the case that a dot on the display is displayed at m/n gradation level by frame thinning method, data on the dot is fixed at "H" (e.g., black) for m frames of n frames, and fixed at "L" (e.g., white) for the remaining frames.

The group of gradation level signals shown in FIG. 2 includes 8 gradation level signals for 8-gradation display, 0/3 (0%), 1/3 (33%), 2/3 (66%), 3/3 (100%), 1/5 (20%), 2/5 (40%), 3/5 (60%) and 4/5 (80%). In the gradation level signal of 1/3 (33%), for example, the first frame is "H", the second and third frames are "L", the fourth frame is "H" . . . , and so continued. The "H" level represents display ON (to work) and the "L" level represents display OFF (not to work). Accordingly, as to the 1/3 gradation level signal, a dot on the display can be displayed once per three frames (displayed in black on a monochrome display, for example). Usually, the frame cycle is very short, approximately for 15 m sec. Therefore, when a dot is displayed with the 1/3 gradation level signals, this dot is visible one third in the depth of black compared with the case in which the whole frames are at display ON (3/3) stage. Similarly, display with 2/3 gradation level signals is darker than that with 1/3 gradation level signals and lighter than that with 3/3 gradation level signals.

The group of the gradation level signals 4 is applied to the selecting circuit 5 at the data inputs D0 to D7. The selecting circuit 5 also receives an intensity signal I, a video signal V and a color signal R2 at its selecting inputs SA to SC. The signals I and V are used for displaying a picture on a monochrome CRT, and the signal R2 is one of signals used for displaying a picture on a color CRT. The signals I and V are usually used for gradation display on a monochrome liquid crystal display, and the signal R2 is additionally used for enabling 8-gradation display in the display control device in FIG. 1. The selecting circuit 5 selects any one of the gradation level signal group 4 in accordance with Table 1 below with the signals I, V and R2 to output from the output Y.

TABLE 1

| R2 | V | I | GRADATION LEVEL |
|---|---|---|---|
| 0 | 0 | 0 | 0/3 (0%) |
| 0 | 0 | 1 | 1/3 (33%) |
| 0 | 1 | 0 | 2/3 (66%) |
| 0 | 1 | 1 | 3/3 (100%) |
| 1 | 0 | 0 | 1/5 (20%) |
| 1 | 0 | 1 | 2/5 (40%) |
| 1 | 1 | 0 | 3/5 (60%) |
| 1 | 1 | 1 | 4/5 (80%) |

As shown in Table 1, any one of the gradation level signals 0/3 to 3/3 is selected in response to the content of 2 bit of the signals I and V when the signal R2 is equal to 0, whereas any one of the gradation level signals 1/5 to 4/5 is selected in response to the content of 2 bit of the signals I and V when the signal R2 is equal to 1. The gradation level signal selected in this way is applied to a monochrome display device such as a monochrome liquid crystal display, whereby the previously mentioned gradation display by means of frame thinning can be carried out.

The conventional display control device constructed as described above switches a gradation level mainly in response to 2 bit signals I and V for a monochrome CRT. For a color CRT, on the other hand, color signals R1, G1 and B1 corresponding to the primary colors of light, i.e., red, green and blue as well as color signals R2, G2 and B2 for fine adjustment therefor are often used instead of the signals I and V.

When the computer system connected to the display control device shown in FIG. 1 operates with software for monochrome display, a picture outputted from the computer system is displayed with the signals I and V, but when it operates with software for color display, the picture is displayed with the signals R1 to B2. Consequently, when software for color display is used for the computer system connected to the display control device shown in FIG. 1 in order to display with gradation the picture outputted from the computer system on a monochrome liquid crystal display by the output from the selecting circuit 5, the gradation level hardly changes because the signals I and V does not change, so that the resulting picture becomes inconspicuous.

SUMMARY OF THE INVENTION

The present invention directed to a display control device for displaying a picture in gradation on a monochrome display device.

A display control device according to the present invention comprises a gradation level generator for generating a plurality of gradation levels, a color data generator for generating color data on the picture, a monochrome data generator for generating monochrome data on the picture, a switching signal generator for generating first and second switching signals, and a gradation level selecting circuit connected to the gradation level generator, color data generator, monochrome data generator and switching signal generator, for selecting one of the plurality of gradation levels in accordance with at least the monochrome data to output it to the monochrome display device when the first switching signal is received from the switching signal generator and selecting one of the plurality of gradation levels in accordance with the color data to output it to the monochrome display device when the second switching signal is received from the switching signal generator.

In the display control device according to the present invention, data used for selecting a gradation level in a gradation level selecting circuit are changed to data for color display or data for monochrome display in response to first and second switching signals. Therefore, appropriate gradation display can be carried out by a monochrome display device using software either for color display or for monochrome display. This provides advantages that software can be made more freely and that various kinds of software can be used in the system.

Accordingly, it is an object of the present invention to provide a display control device which can display a conspicuous picture with gradation on a monochrome display device such as a monochrome liquid crystal display using software either for monochrome display or for color display.

These and other objects, features, aspects and advantages of the present invention will become more apparent from the following detailed description of the present invention when taken in conjunction with the accompanying drawings.

DETAILED DESCRIPTION OF THE PREFERRED EMBODIMENT

Figure 3:
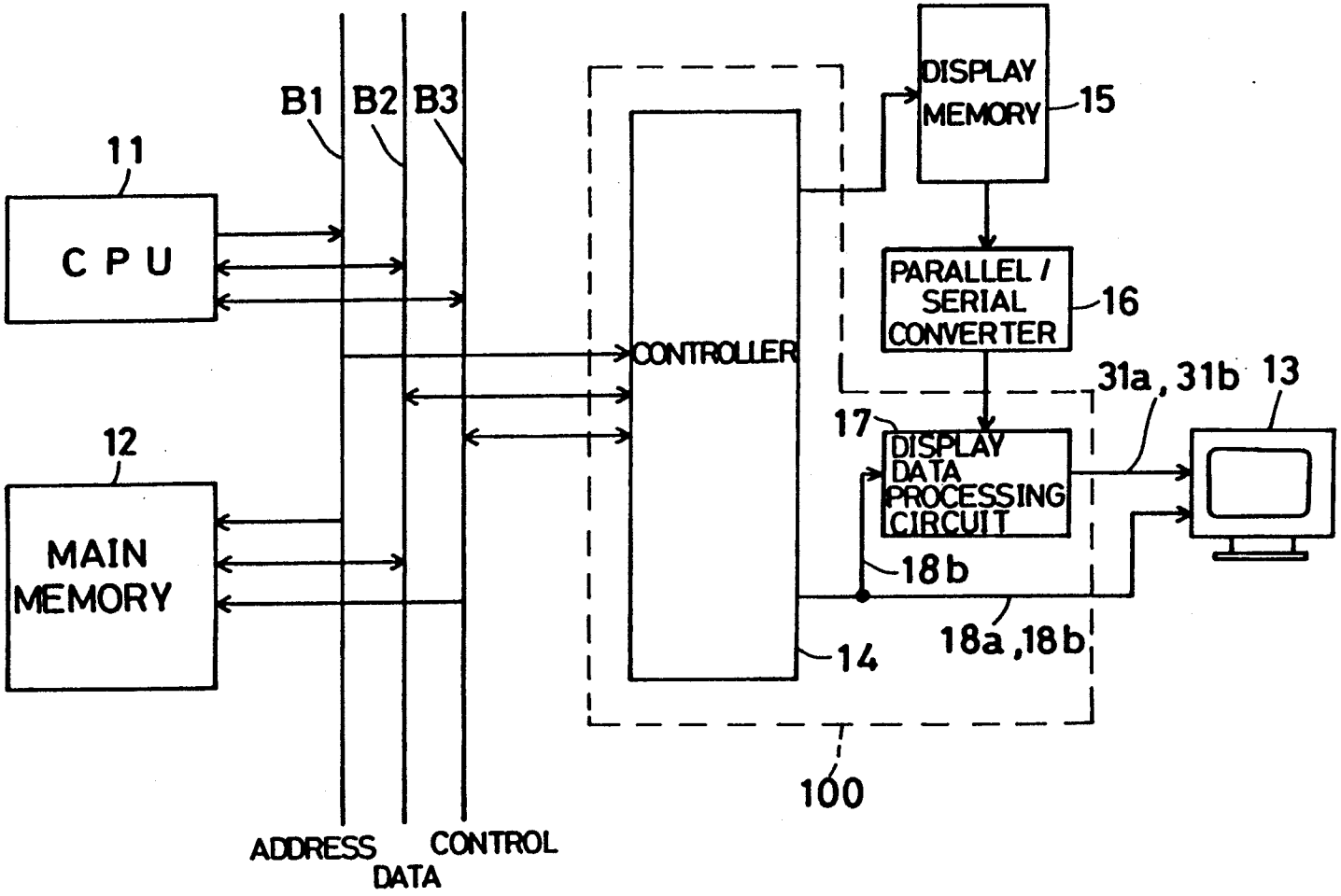
FIG. 3 is a block diagram showing an example of a computer system to which a display control device according to the present invention is applied.

FIG. 3 is a block diagram showing an example of a computer system to which a display control device according to the present invention is applied. The system includes a CPU 11 and a main memory 12 interconnected through address, data and control buses B1, B2 and B3. A picture outputted from the system is displayed on a display 13 through a display control device 100.

The display control device 100 includes a controller 14 connected to the address, data and control buses B1, B2 and B3. Display data representing the picture outputted from the system temporarily stored in a display memory 15 through the controller 14. The display data stored in the display memory 15 is read as parallel data and converted into serial data through a parallel/serial converter 16. A display data processing circuit 17 in the display control device 100 receives serial display data from the parallel/serial converter 16 and a vertical synchronizing signal 18*b* from the controller 14 to produce various display signals 31*a* and 31*b* necessary for display with a display device 13 such as a monochrome CRT, a color CRT and a monochrome liquid crystal display. The display device 13 receives necessary one of the signals 31*a* and 31*b* from the display data processing circuit 17 and horizontal and vertical synchronizing signals 18*a* and 18*b* from the controller 14 and displays the picture outputted from the system.

Figure 1:
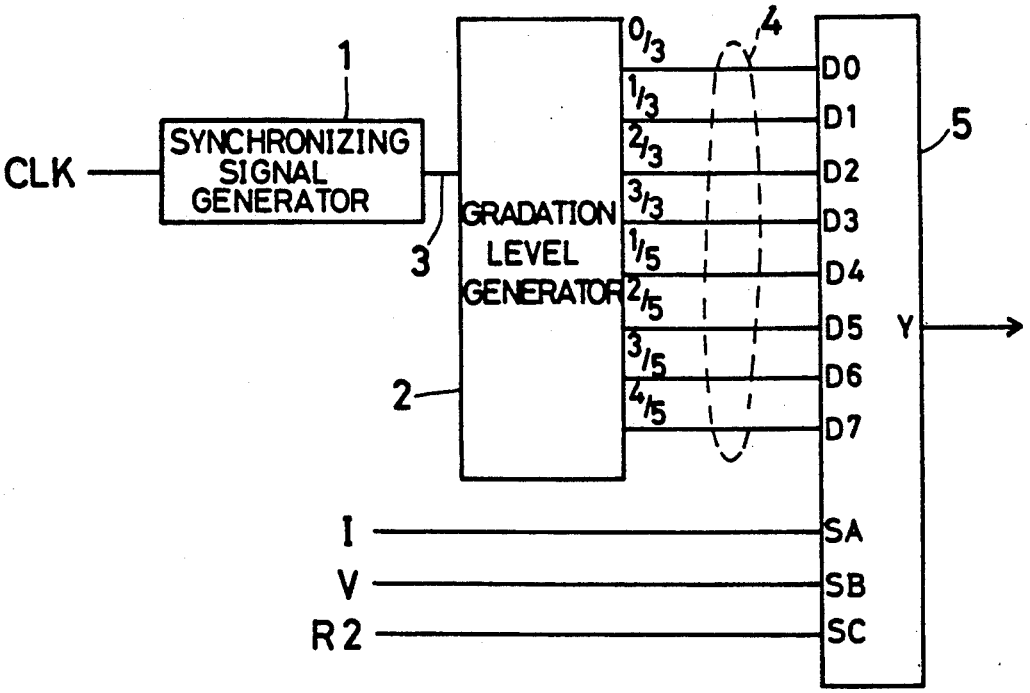
FIG. 1 (BACKGROUND ART)
FIG. 1 is a block diagram showing a conventional display control device.
Figure 2:
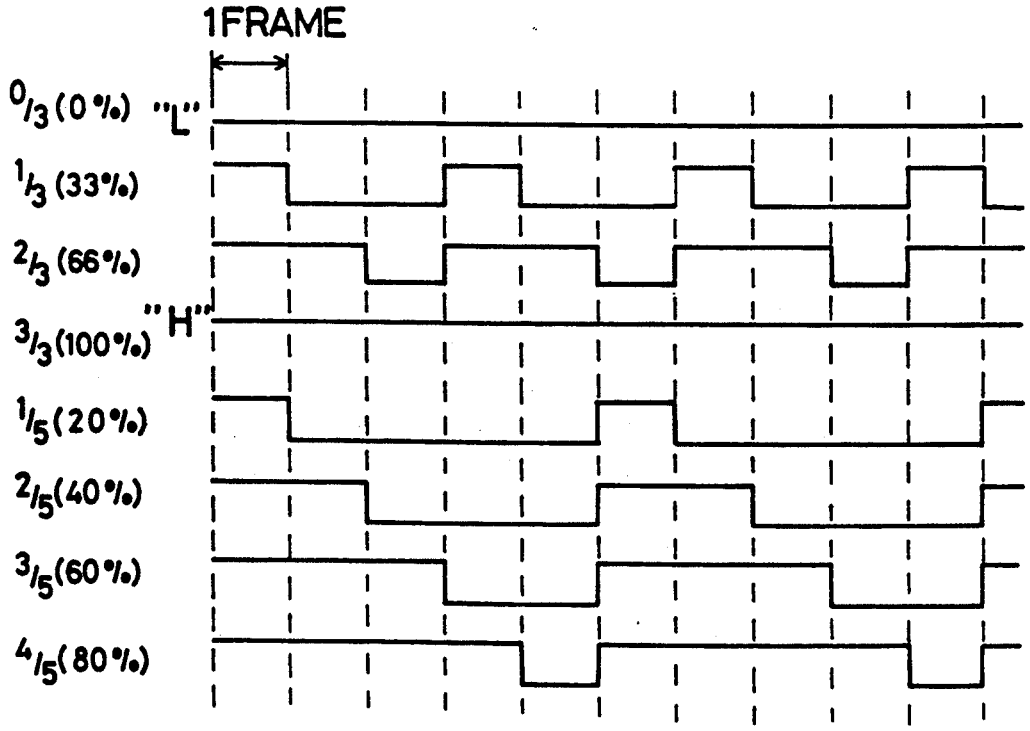
FIG. 2 (BACKGROUND ART)
FIG. 2 is a wave form chart showing a group of gradation level signals.
Figure 4:
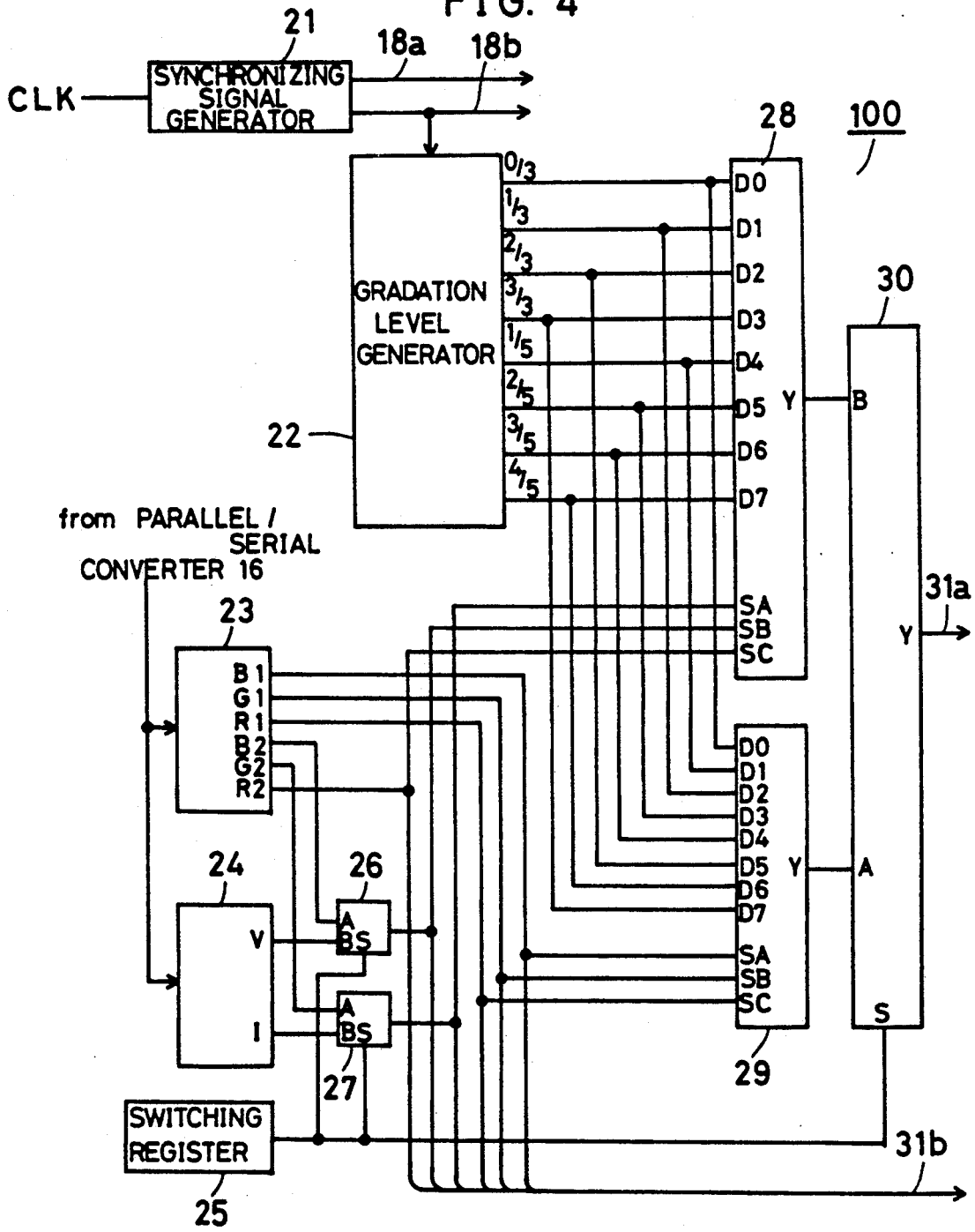
FIG. 4 is a block diagram showing an embodiment of the display control device according to the present invention.

FIG. 4 is a block diagram showing an embodiment of the display control device 100. The display control device 100 includes a synchronizing signal generator 21 provided in the controller 14 of FIG. 3. The synchronizing signal generator 21 receives a clock signal CLK for generating timing to produce horizontal and vertical synchronizing signals 18*a*, 18*b*. A gradation level generator 22 receives the vertical synchronizing signal 18*b* from the synchronizing signal generator 21 to produce a group of gradation level signals shown in FIG. 2.

Figure 5:
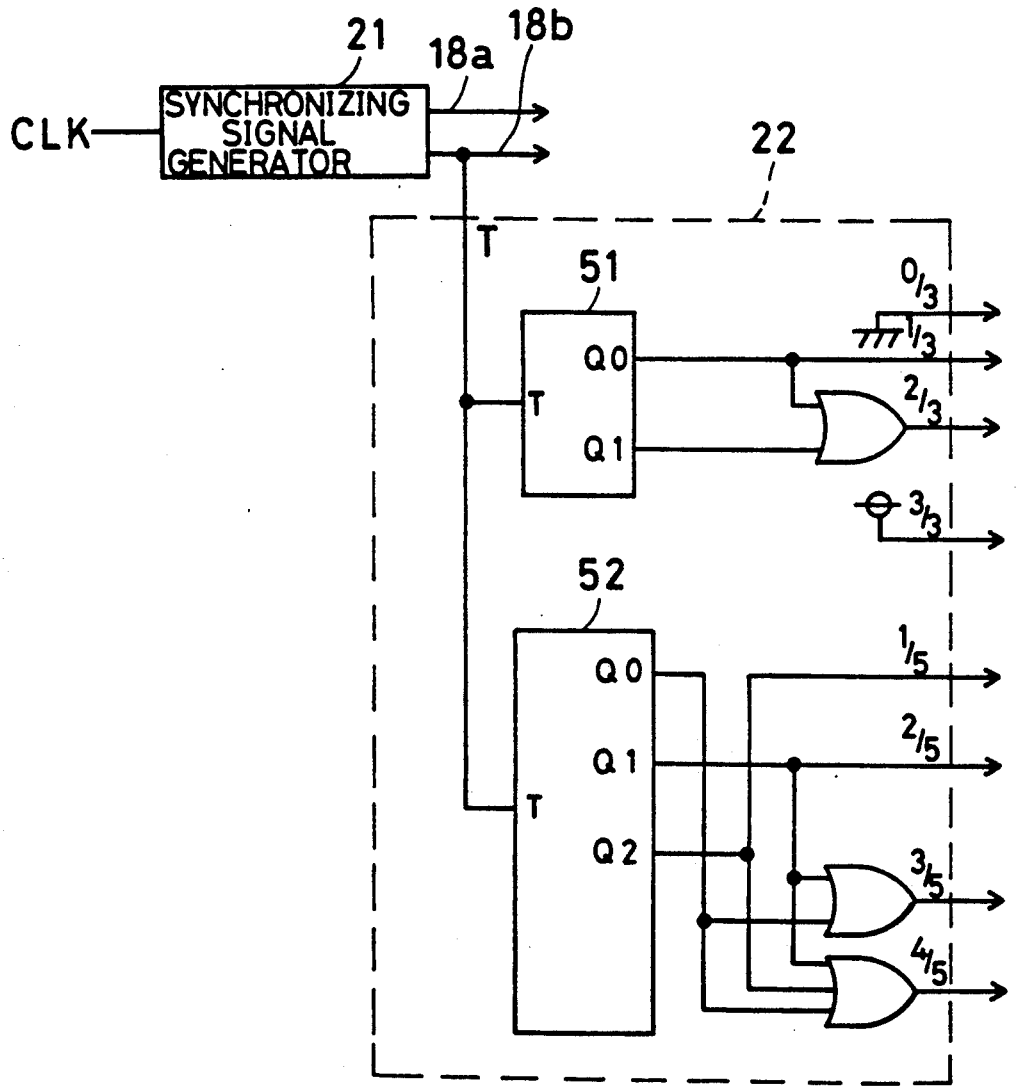
FIG. 5 is a block diagram showing an exemplary construction of a gradation level generator.

FIG. 5 is a block diagram showing an example of a gradation level generator 22. The gradation level generator 22 includes ternary and quinary counters 51 and 52 which receive the vertical synchronizing signal 18*b* from the synchronizing signal generator 21 at the respective timing inputs T. The ternary counter 51 has a least significant bit output Q0 and a most significant bit output Q1. The quinary counter 52 has a least significant bit output Q0, a medium bit output Q1 and a most significant bit output Q2. A signal from the output Q0 of the ternary counter 51 means a 1/3 gradation level, signals from the outputs Q0 and Q1 of the ternary counter 51 through an OR gate means a 2/3 gradation level. In the quinary counter 52, a signal from the output Q2 means a 1/5 gradation level, a signal from the output Q1 means a 2/5 gradation level, signals from the outputs Q0 and Q1 through an OR gated means a 3/5 gradation level, and signals from the outputs Q0, Q1 and Q2 through an OR gate means a 4/5 gradation level. Further, a signal fixed at the ground level ("L" level) is produced as a 0/3 gradation level signal, and a signal fixed at the power supply level ("H" level) is produced as a 3/3 gradation level.

Referring to FIG. 4 again, the display control device 100 includes color and monochrome data generators 23 and 24. The color data generator 23 receives serial display data for color display from the parallel/serial converter 16 in FIG. 3 so as to produce color signals B1, G1 and R1 corresonding to blue, green and red, respectively, as well as color signals B2, G2 and R2 for fine adjustment of those color signals B1, G1 and R1. The monochrome data generator 24 receives serial display data for monochrome display from the parallel/serial converter 16 of FIG. 3 to produce a video signal V and an intensity signal I.

A switching register 25 stores 1 bit data, for example, for color/monochrome swiching. A conventional register employed in the system may be substituted for the switching register 25. A selector 26 receives at its input A the color signal B2 from the color data generator 23 and at its input B the video signal V from the monochrome data generator 24. The selector 26 selectively outputs one of these signals B2 and V depending upon the content of the switching register 25. A selector 27 receives at its input A a color signal G2 from the color data ganerator 23 and at its input B the intensity signal I from the monochrome data generator 24. The selector 27 selectively outputs one of these signals G2 and I depending upon the content of the switching register 25.

A gradation level selecting circuit for selecting a gradation level consists of first and second selecting circuits 28 and 29 and a selector 30. The first selecting circuit 28 receives a group of gradation level signals from the gradation level generator 22 at its data inputs D0 to D7. Furthermore, the circuit 28 receives the output of the selector 27, the output of the selector 26 and the color signal R2 from the color data generator 23 at its selecting inputs SA, SB and SC, respectively. The second selecting circuit 29 receives a group of gradation level signals from the gradation level generator 22 at its data inputs D0 to D7 and the color signals B1, G1 and R1 from the color data generator 23 at its selecting inputs SA, SB and SC, respectively. Outputs Y of the first and second selecting circuits 28 and 29 are applied to the inputs B and A of the selector 30, respectively. Depending upon the content of the switching register 25, the selector 30 selects either one of the inputs A and B to output it as a display signal 31*a* from the output Y. A monochrome display device such as a monochrome liquid crystal display receives the display signal 31*a* to perform display in gradation. On the other hand, a group of signals consisting of the color signals B1, G1, R1 and R2 from the color data generator 23 and the output signals from the selectors 26 and 27 are outputted as display signals 31*b*. A color and monochrome CRT receives the display signals 31*b* to perform display.

In operation, while the system shown in FIG. 3 is operating with software for monochrome display, the switching register 25 shown in FIG. 4 is set at "1", for example. In response to this, the selectors 26, 27 and 30 select the input B. The monochrome data generator 24 receives serial display data for monochrome display from the parallel/serial converter 16 to produce the video signal V and the intensity signal I corresponding to the serial display data as received. The first selecting circuit 28 selects any one signal of the gradation level signal groups from the gradation level generator 22 in accordance with, for example, previous Table 1 through the signals V and I from the monochrome data generator 24 and the color signal R2 from the color data generator 23. Thus selected gradation level signal is applied, for example, to a monochrome liquid crystal display as the display signal 31*a* through the selector 30. The output Y of the second selecting circuit 29 is inabled by the selector 30. Thus, a gradation picture outputted from the system which operates with software for monochrome display is displayed on the monochrome liquid crystal display by means of frame thinning. In this mode, the display signal 31*b* includes the color signals B1, G1, R1 and R2 from the color data generator 23 and the video signal V and intensity signal I from the monochrome data generator 24. Accordingly, a picture outputted from the system can be displayed on the monochrome CRT by applying the video and intensity signals V and I in the display signal 31*b* to the monochrome CRT.

Meanwhile, while the system of FIG. 3 is operating with software for color display, the switching register 25 of FIG. 4 is, for example, set at "0". In response to this, the selectors 26, 27 and 30 select the input A. The color data generator 23 receives serial display data for color from the parallel/serial converter 16 so as to produce color signals B1, G1, R1, B2, G2 and R2 corresponding to the serial display data as received. The second selecting circuit 29 selects any one signal of the gradation level signal groups from the gradation level generator 22 in accordance with, for example, the following Table 2 with color signals B1, G1 and R1.

TABLE 2

| R1 | G1 | B1 | GRADATION LEVEL |
|---|---|---|---|
| 0 | 0 | 0 | 0/3 (0%) |
| 0 | 0 | 1 | 1/5 (20%) |
| 0 | 1 | 0 | 1/3 (33%) |
| 0 | 1 | 1 | 2/5 (40%) |
| 1 | 0 | 0 | 3/5 (60%) |
| 1 | 0 | 1 | 2/3 (66%) |
| 1 | 1 | 0 | 4/5 (80%) |
| 1 | 1 | 1 | 3/3 (100%) |

As can be seen in Table 2, the gradation levels are selected so that tone becomes darker from white to black, for example, in order of the codes 0 to 7 for the signals R1, G1 and B1. The gradation level signals thus selected by the second selecting circuit 29 are applied to, for example, a monochrome liquid crystal display as the display signal 31*a* through the selector 30. Thus, a gradation picture outputted form the system which operates with software for color display can be displayed conspicuously on the monochrome liquid crystal display by mens of frame thinning. In this mode, the display signal 31*b* includes the color signals B1, G1, R1, B2, G2 and R2 from the color data generator 23. These color signals may be applied to the color CRT so that a color picture outputted from the system can be displayed on the color CRT.

Figure 6:
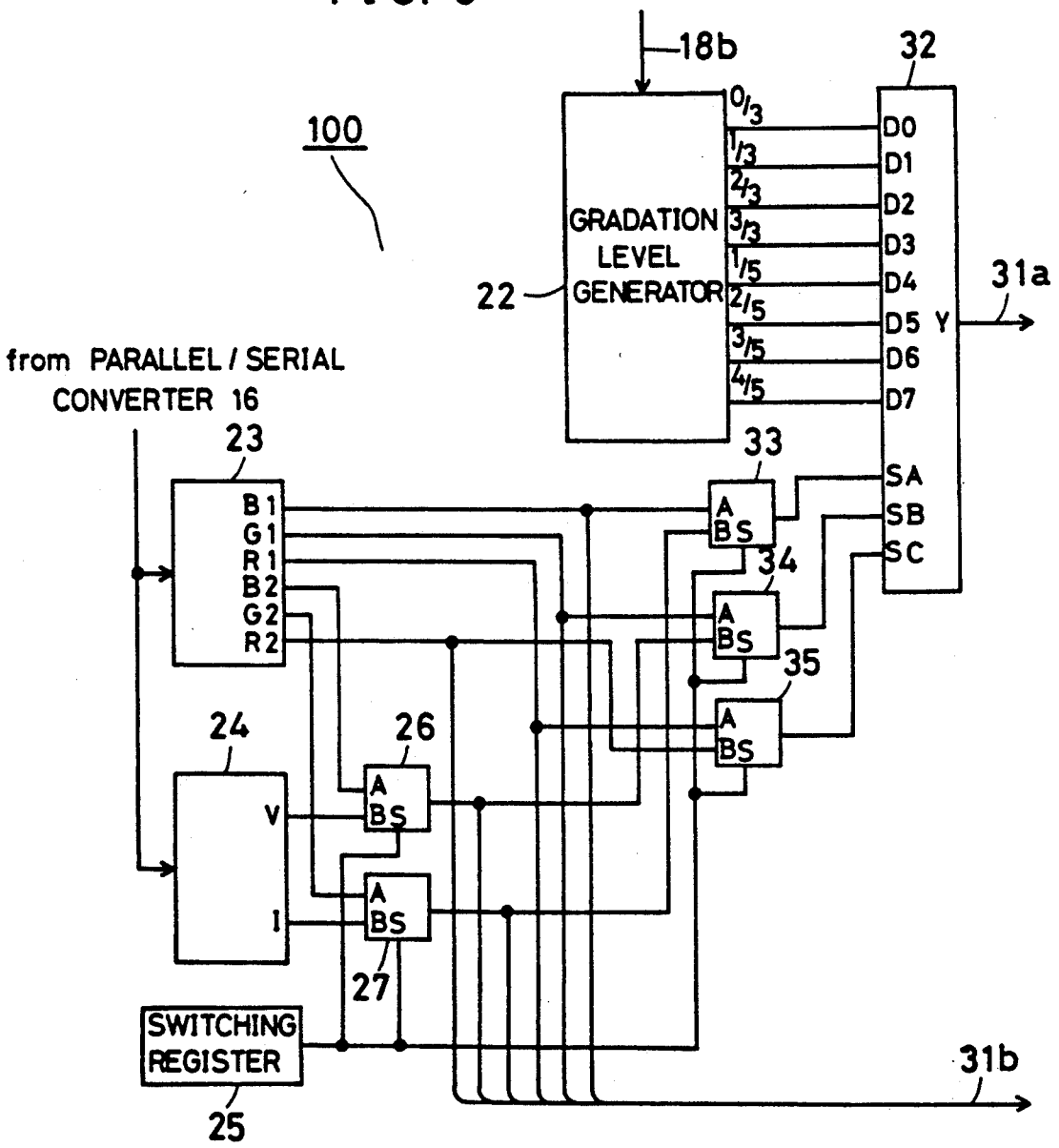
FIG. 6 is a block diagram showing another embodiment of the display control device according to the present invention.

FIG. 6 is a block diagram showing another embodiment of the display control device according to the present invention. The display control device 100 comprises a gradation level selecting circuit in which only one selecting circuit 32 is used. The selecting circuit 32 receives a group of gradation level signals from a gradation level generator 22 at its data inputs D0 to D7 and the outputs of respective selectors 33, 34 and 35 at its selecting inputs SA, SB and SC. Similar to selectors 26 and 27, selectors 33, 34 and 35 select the input B in response to "1" (software for monochrome display) of a switching register 25 or the input A in response to "0" (software for color display). In the former case, an intensity signal I and a video signal V from a monochrome data generator 24 and a color signal R2 from a color data generator 23 are applied to the selecting inputs SA, SB and SC of the selecting circuit 32, respectively. In the latter case, color signals B1, G1 and R1 from the color data generator 23 are applied to the selecting inputs SA, SB and SC of the selcting circuit 32, respectively. Thus, the selecting circuit 32 functions the same as the selecting circuit 28 in FIG. 4 when the content of the switching register 25 is "1", and functions the same as the selecting circuit 29 in FIG. 4 when the content is "0". Accordingly, with a display signal 31*a* outputted from the output Y of the selecting circuit 32, conspicuous gradation display can be attained on a monochrome display device such as a monochrome liquid crystal display by means of frame thinning in either case that the system shown in FIG. 3 operates with software for monochrome display or for color display.

In the foregoing, the embodiments with 8-gradation display has been described. However, the present invention can be applied to 4-gradation display, 16-gradation display or the like. Moreover, the order of the gradation level is not limited to that shown in Table 1 or Table 2, and it may be arbitrary.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A display control device for displaying a picture in gradation on a monochrome display device, comprising:

a gradation level generator for generating a plurality of gradation levels;

a color data generator for generating color data on said picture;

a monochrome data generator for generating monochrome data on said picture;

a switching signal generator for generating first and second switching signals; and a gradation level selecting circuit connected to said gradation level generator, color data generator, monochrome data generator and switching signal generator, for selecting one of said plurality of gradation levels in accordance with at least said monochrome data to output it to said monochrome display device when said first switching signal is received from said switching signal generator and selecting one of said plurality of gradation levels in accordance with said color data to output it to said monochrome display device when said second switching signal is received from said switching signal generator.

2. A display control device in accordance with claim 1, wherein said gradation level selecting circuit comprises a first selecting circuit coupled to said gradation level generator and said monochrome data generator, for selecting one of said plurality of gradation levels in accordance with said monochrome data, a second selecting circuit coupled to said gradation level generator and said color data generator, for selecting one of said plurality of gradation levels in accordance with said color data, and an output selector connected to said first and second selecting circuits and said switching signal generator, for selecting an output of said first selecting circuit in response to said first switching signal and an output of said second selecting circuit in response to said second switching signal.

3. A display control device in accordance with claim 2, wherein said first selecting circuit is further coupled to said color data generator so as to select one of said plurality of gradation levels in accordance with said monochrome data and predetermined one of said color data.

4. A display control device in accordance with claim 1, wherein said gradation level selecting circuit comprises a data selector coupled to said monochrome and color data generator and said switching signal generator, for outputting said monochrome data in response to said first switching signal and said color data in response to said second switching signal, and a selecting circuit connected to said gradation level generator and said data selector, for selecting one of said plurality of gradation levels in accordance with an output of said data selector.

5. A display control device in accordance with claim 4, wherein said data selector outputs said monochrome data and predetermined one of said color data in response to said first switching signal.

6. A display control device in accordance with claim 1, wherein said plurality of gradation levels include gradation levels in a frame thinning system.

7. A display control device in accordance with claim 6, wherein said monochrome display device includes a monochrome liquid crystal display.

8. A display control device in accordance with claim 6, further comprising a synchronizing signal generator for generating a synchronizing signal, wherein said gradation level generator comprises a counter connected to said synchronizing signal generator for counting said synchronizing signal, and a logic circuit connected to said counter for producing said plurality of gradation levels from an output of said counter.

* * * * *